US007013658B2

(12) United States Patent
Dobmeier et al.

(10) Patent No.: US 7,013,658 B2
(45) Date of Patent: Mar. 21, 2006

(54) REFRIGERANT SUBCOOLING BY CONDENSATE

(75) Inventors: Thomas J. Dobmeier, Phoenix, NY (US); Michael F. Taras, Fayetteville, NY (US); Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 9 days.

(21) Appl. No.: 10/771,161

(22) Filed: Feb. 3, 2004

(65) Prior Publication Data

US 2005/0166614 A1 Aug. 4, 2005

(51) Int. Cl.
*F25D 21/00* (2006.01)
*F25D 5/00* (2006.01)
*F25B 47/00* (2006.01)

(52) U.S. Cl. ..... 62/150; 62/279; 62/305; 62/506; 62/513

(58) Field of Classification Search ..... 62/150, 62/513, 113, 305, 506, 279, 280
See application file for complete search history.

(56) References Cited

U.S. PATENT DOCUMENTS 4,280,334 A * 7/1981 Lakdawala ..... 62/277
4,876,859 A 10/1989 Kitamoto
5,113,668 A * 5/1992 Wachs et al. ..... 62/305
5,638,695 A 6/1997 Kamio et al.
5,682,757 A * 11/1997 Peterson ..... 62/259.2
5,797,277 A * 8/1998 Hong et al. ..... 62/285
5,875,637 A 3/1999 Paetow
5,979,172 A * 11/1999 Teller ..... 62/305
6,047,556 A 4/2000 Lifson
6,070,423 A * 6/2000 Hebert ..... 62/277
6,206,652 B1 3/2001 Caillat
6,237,359 B1 * 5/2001 Hebert ..... 62/348
6,463,751 B1 * 10/2002 Teller ..... 62/305
6,592,333 B1 * 7/2003 Magallanes ..... 417/36

OTHER PUBLICATIONS

Systems & Advanced Technologies Engineering S.r.l., publication entitled "Compsys—Dynamic Simulation of Gas Compression Plants", dated Jun. 12, 2002.
Copeland Europe publication entitled "Refrigeration Scroll for Parallel Applications" dated Feb. 26, 2002.
International Search Report dated May 12, 2005.

* cited by examiner

*Primary Examiner*—Marc Norman
(74) *Attorney, Agent, or Firm*—Carlson, Gaskey & Olds

(57) ABSTRACT

Refrigerant is circulated through a vapor compression system including a compressor, a condenser, an expansion device, and an evaporator. Cold condensate forms on the evaporator surfaces as the refrigerant accepts heat from an air stream. The cold condensate drips down from the evaporator coil and collects in a condensate pan. In one example, the cold condensate is directed into a condensate heat exchanger to subcool the refrigerant exiting the condenser. In another example, the refrigerant exiting the condenser flows through a refrigerant line located in the condensate pan. In another example, the cold condensate is sprayed on the refrigerant line exiting the condenser or on the subcooling portion of the condenser. By utilizing the condensate for further subcooling of the refrigerant, system capacity and efficiency are enhanced. Various control techniques and condensate flow methods are also disclosed.

26 Claims, 3 Drawing Sheets

REFRIGERANT SUBCOOLING BY CONDENSATE

BACKGROUND OF THE INVENTION

The present invention relates generally to a vapor compression system that uses the cold condensate from an evaporator to further subcool refrigerant exiting the condenser to increase system capacity and efficiency.

In a vapor compression system, refrigerant is compressed to a high pressure in a compressor. The refrigerant then flows through a condenser and rejects heat to a secondary fluid medium. The high pressure and relatively low enthalpy refrigerant is then expanded in an expansion device. The refrigerant then passes through an evaporator and accepts heat from another secondary fluid medium, such as air. The relatively high enthalpy and low pressure refrigerant then reenters the compressor, completing the cycle.

When refrigerant flows through the evaporator, moisture is removed from the air stream, and cold condensate forms on the surface of the evaporator coil. The cold condensate typically drips from the evaporator surface into a drain pan and is discharged from the system through a drain, for example.

It is desirable to further subcool the refrigerant exiting the condenser before expansion to increase system capacity and efficiency. In a prior art system, the cold condensate is collected and randomly sprayed directly on the surface of the condenser coil to assist heat rejection from the refrigerant in the condenser and reduce the discharge pressure of the refrigerant.

A drawback of this prior art system is that it is not effective, particularly in high efficiency vapor compression systems having large condenser coils, since the heat rejected in the condenser is still limited by the outdoor air temperature. As the size of the condenser coil increases, the amount of heat rejected in the condenser coil does not increase proportionally. Therefore, the cold condensate has little cooling effect on the large condenser coils. Thus, the driving force for the heat rejection diminishes, establishing a limit for further refrigerant temperature reduction.

There is a need in the art for a vapor compression system including additional heat rejection in the condenser and to further subcool the liquid refrigerant exiting the condenser to increase system capacity and efficiency.

SUMMARY OF THE INVENTION

In general terms, this invention utilizes condensate produced during system operation for further subcooling of the refrigerant in the system.

One example system includes a compressor, a condenser, an evaporator an expansion device between the condenser and the evaporator, and refrigerant lines connecting these components. The system further includes a subcooling portion that facilitates subcooling of the refrigerant flowing between the condenser and the expansion device using the condensate that forms on the evaporator.

One example vapor compression system includes a compressor, a condenser, an expansion device, and an evaporator. Refrigerant is circulated though the closed circuit system. The compressor compresses the refrigerant to a high pressure and a high enthalpy state. As the refrigerant flows through the condenser, the refrigerant rejects heat to a secondary fluid medium and exits the condenser at a relatively low enthalpy and a high pressure. The liquid refrigerant exiting the condenser is further subcooled by condensate formed on the evaporator surfaces and delivered for a heat transfer interaction with this refrigerant. When refrigerant in the evaporator exchanges heat with the air, moisture is removed from the air stream, forming a cold condensate on the evaporator surfaces collected in a condensate pan. The further subcooled refrigerant is then expanded to a low pressure in an expansion device. After expansion, the refrigerant flows through an evaporator and accepts heat from the air stream. The refrigerant exits the evaporator at a relatively high enthalpy and a low pressure. After evaporation, the refrigerant reenters the compressor, completing the cycle.

In one inventive example, the cold condensate flows by gravity onto the refrigerant line between the condenser and the expansion device or onto a subcooling portion of the condenser coil to further subcool the liquid refrigerant before expansion.

In another inventive example, the refrigerant line exiting the condenser is located in the condensate pan. The refrigerant in the refrigerant line exiting the condenser rejects heat to the cold condensate in the condensate pan, further subcooling the refrigerant.

In another inventive example, the cold condensate collected in the condensate pan is selectively sprayed on the refrigerant line exiting the condenser or on the subcooling portion of the condenser to further subcool the refrigerant.

In another inventive example, the refrigerant flows through a condensate heat exchanger positioned between the condenser and the expansion device and is further subcooled by the cold condensate that is removed from the indoor air stream. After accepting heat from the refrigerant in the condensate heat exchanger, the condensate is discharged from the system through a drain.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawing that accompanies the detailed description can be briefly described as follows.

DETAILED DESCRIPTION OF THE PREFERRED EMBODIMENT

Figure 1:
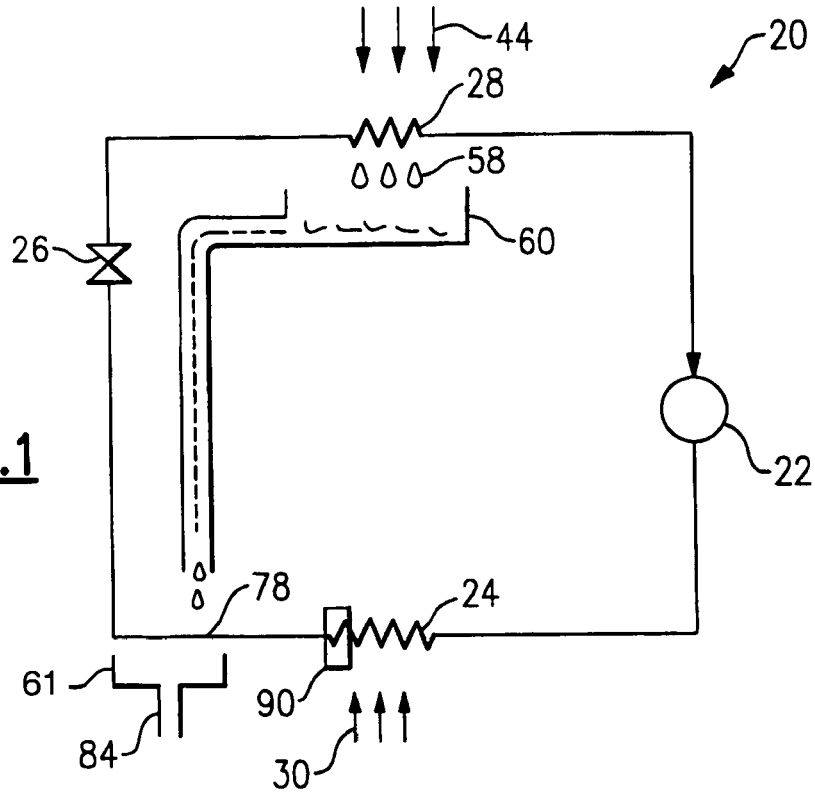
FIG. 1 schematically illustrates a diagram of a first embodiment of the vapor compression system of the present invention.

FIG. 1 illustrates an example vapor compression system 20 including a compressor 22, a condenser 24, an expansion device 26, and an evaporator 28. The refrigerant exits the compressor 22 at a high pressure and a high enthalpy. The refrigerant then flows through the condenser 24 at a high pressure. An external fluid medium 30, such as water or air, also flows through the condenser 24 and exchanges heat with the refrigerant flowing through the condenser 24. In the condenser 24, the refrigerant rejects heat into the external fluid medium 30, and the refrigerant exits the condenser 24 at a relatively low enthalpy and a high pressure.

The refrigerant then passes through the expansion device 26, which expands the refrigerant, reducing its pressure and temperature. The expansion device 26 can be a mechanical expansion device (TXV), an electronic expansion valve (EXV) or other type of known expansion device.

After expansion, the refrigerant flows through the evaporator 28 and exits at a relatively high enthalpy and a low pressure. In the evaporator 28, the refrigerant absorbs heat from the air stream 44. When the refrigerant exchanges heat with the air stream 44 in the evaporator 28, moisture is removed from the air stream 44 and forms a cold condensate 58 that collects in a condensate pan 60. In one example, the condensate pan 60 is positioned under the evaporator 28.

In the embodiment illustrated in FIG. 1, the cold condensate 58 removed from the conditioned indoor air stream 44 collects on the evaporator surfaces and drips into the condensate pan 60. The cold condensate 58 eventually drips onto a refrigerant line 78 between the condenser 24 and the expansion device 26. The cold condensate 58 can drip onto the refrigerant line 78 by gravity. The cold condensate 58 accepts heat from the refrigerant in the refrigerant line 78, further subcooling the liquid refrigerant prior to the refrigerant entering in the expansion device 26. The condensate is then collected in a supplemental drain pan 61 and removed from the system 20 through a drain 84. Alternately, the cold condensate 58 can be applied onto a subcooling section 90 of the condenser 24.

Subcooling the liquid refrigerant using the condensate 58 increases the capacity and efficiency of the system 20.

Figure 2:
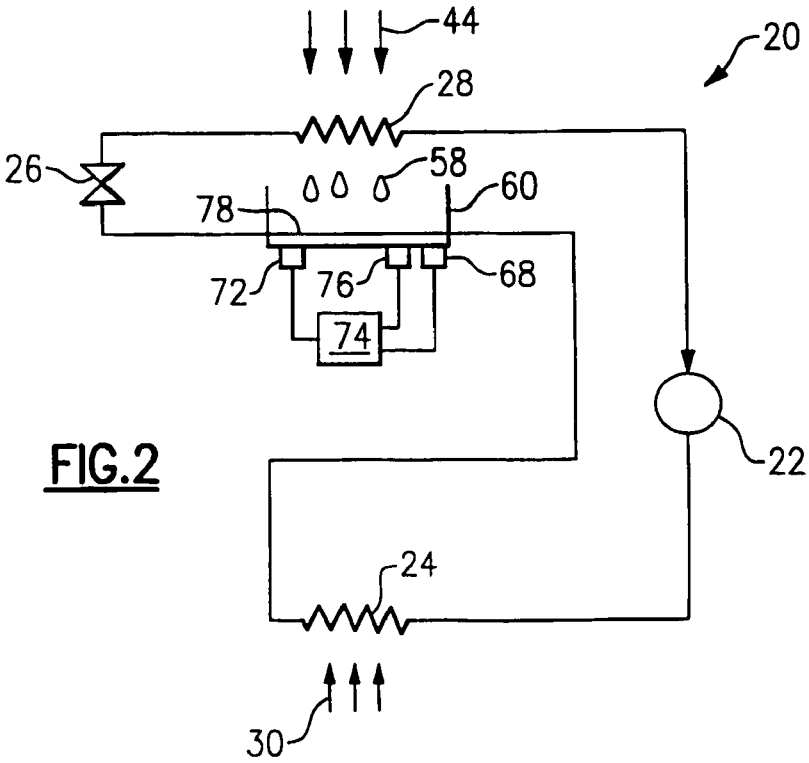
FIG. 2 schematically illustrates a diagram of a second embodiment of the vapor compression system of the present invention.

FIG. 2 schematically illustrates a second embodiment. The refrigerant line 78 exiting the condenser 24 is positioned at least partially in the condensate pan 60. After exiting the condenser 24, the liquid refrigerant flows through the refrigerant line 78 and is further subcooled by the cold condensate 58 collected in the condensate pan 60. The subcooled refrigerant then flows through the expansion device 26 and is expanded to a low pressure and temperature.

The cold condensate 58 in the condensate pan 60 accepts heat from the refrigerant in the refrigerant line 78. When the collected condensate 58 is heated, it becomes less effective in subcooling the refrigerant in the refrigerant line 78. Moreover, the condensate 58 collected in the condensate pan 60 is heated by the refrigerant, and therefore precautions must be taken to prevent an unlikely event of condensate 58 re-evaporating and reentering the air stream 44 flowing through the evaporator 28. In one example, the system 20 includes a temperature sensor 76 to detect the temperature of the condensate 58 collected in the condensate pan 60. When the temperature sensor 76 detects that the temperature of the condensate 58 in the condensate pan 60 is above a threshold value, the temperature sensor 76 sends a signal to a control 74. The control 74 sends a signal to open a drain 72 and drain the warm condensate 58 from the condensate pan 60. After draining the warm condensate 58, cold condensate 58 is again collected in the condensate pan 60 during heat exchanger between the air stream 44 and the refrigerant flowing through the evaporator 28. One skilled in the art would know what threshold temperature to employ.

Alternately, the system 20 includes a level sensor 68 to detect the amount of the condensate 58 collected in the condensate pan 60. When the level sensor 68 detects that the amount of the condensate 58 collected in the condensate pan 60 is above a threshold value, the level sensor 68 sends a signal to the control 74. The control 74 sends a signal to open the drain 72 and drain the warm condensate 58 from the condensate pan 60. After draining the warm condensate 58, the cold condensate 58 is again collected in the condensate pan 60. One skilled in the art would know what threshold temperature to employ. Also, it should be understood that both the temperature sensor 76 and the level sensor 68 can be utilized simultaneously.

Figure 3:
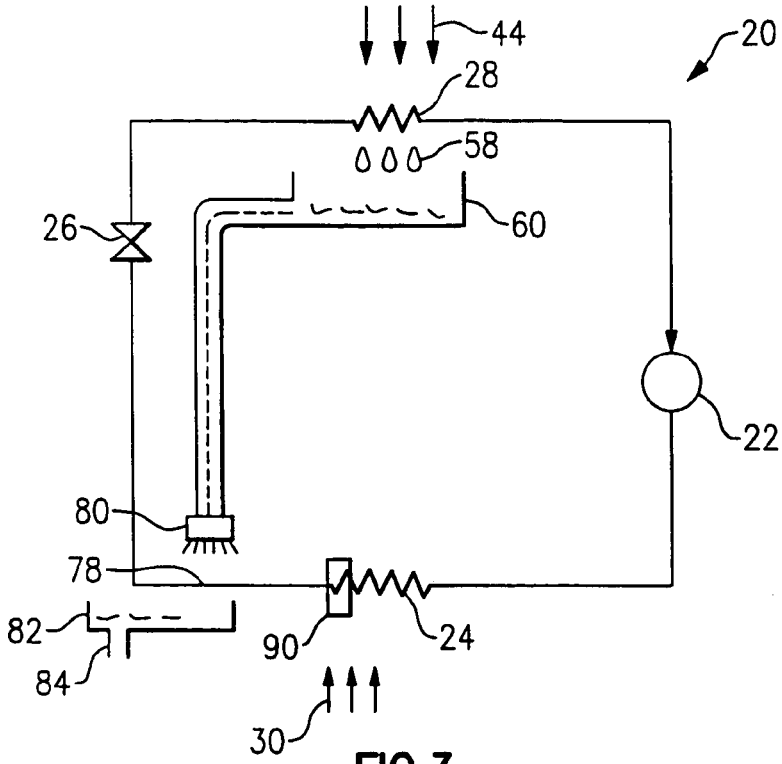
FIG. 3 schematically illustrates a diagram of a third embodiment of the vapor compression system of the present invention.

FIG. 3 schematically illustrates another embodiment. In this embodiment, the cold condensate 58 collected in the condensate pan 60 is selectively sprayed onto the refrigerant line 78 exiting the condenser 24 by a spraying device 80 to additionally subcool the refrigerant. The cold condensate 58 collected in the condensate pan 60 flows to the spraying device 80 by gravity. The cold condensate 58 sprayed on the refrigerant line 78 accepts heat from and further subcools the liquid refrigerant in the refrigerant line 78. After the condensate 58 is sprayed on the refrigerant line 78, the heated condensate is collected in a pan 82 and removed from the system 20 through the drain 84. Alternately, instead of spraying the cold condensate 58 on the refrigerant line 78 exiting the condenser 24, the cold condensate 58 can be sprayed on the subcooling section 90 of the condenser coil of the condenser 24.

Figure 4:
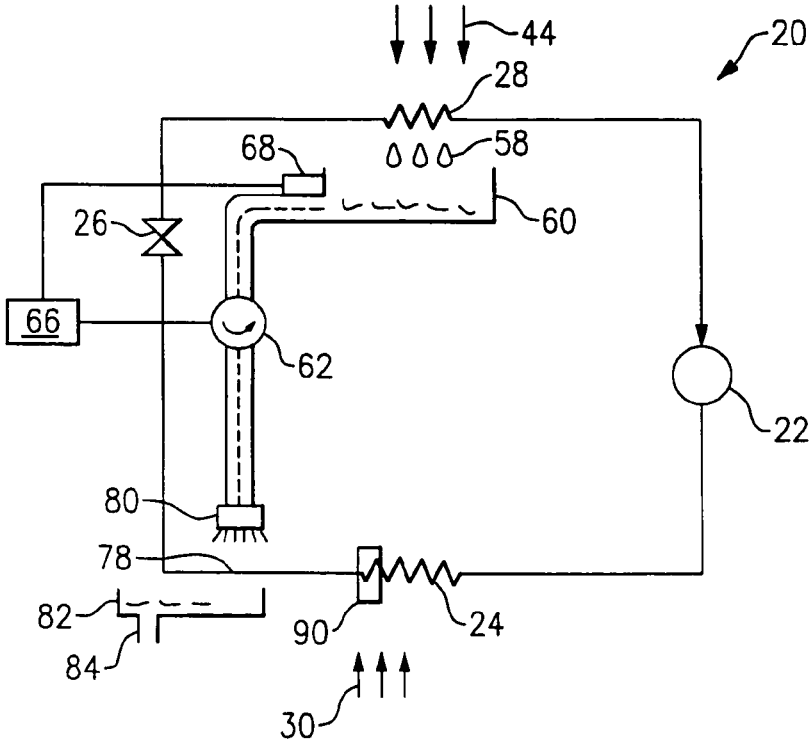
FIG. 4 schematically illustrates a diagram of the third embodiment of the vapor compression system of the present invention employing a fluid pumping device.

FIG. 4 schematically illustrates another embodiment of a vapor compression system 20. In this embodiment, the system 20 further includes a flow control device 62 that directs the condensate 58 from the condensate pan 60 and into the spraying device 80. The flow control device 62 can be a pump or a valve. The spraying device 80 then sprays the cold condensate 58 onto the refrigerant line 78 to accept heat from and further subcool the liquid refrigerant in the refrigerant line 78. After the condensate 58 is sprayed on the refrigerant line 78, the heated condensate is collected in the pan 82 and removed from the system 20 through the drain 84. Alternately, the cold condensate 58 can be sprayed on the subcooling section 90 of the condenser 24.

Figure 5:
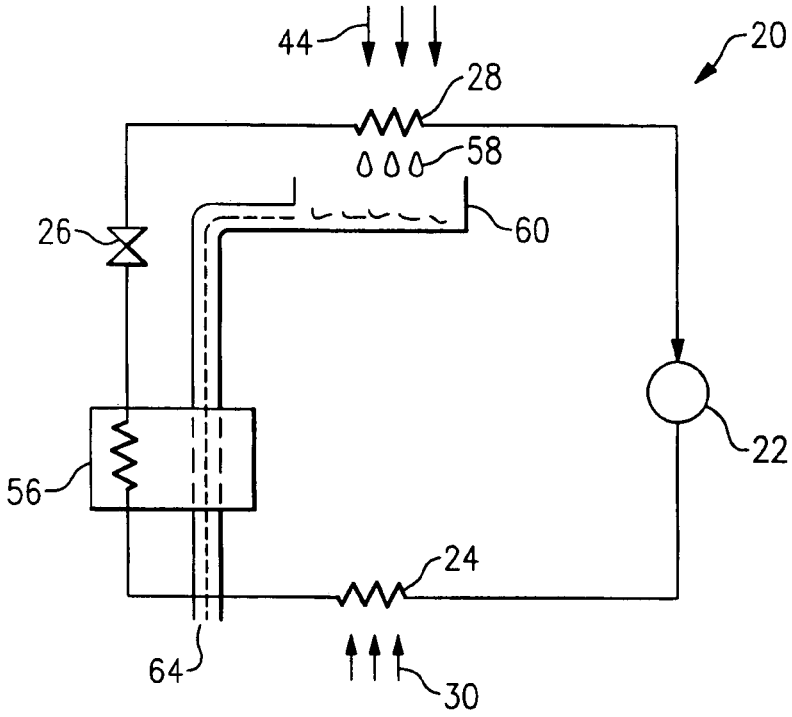
FIG. 5 schematically illustrates a diagram of a fourth embodiment of the vapor compression system of the present invention.

FIG. 5 schematically illustrates an alternate embodiment including a condensate heat exchanger 56. The cold condensate 58 collected in the condensate pan 60 flows into the condensate heat exchanger 56 by gravity. In the condensate heat exchanger 56, the cold condensate 58 accepts heat from the liquid refrigerant exiting the condenser 24 to further subcool the refrigerant. After accepting heat from the refrigerant in the condensate heat exchanger 56, the heated condensate 58 is drained and removed from the system 20 through a drain 64. In one example, the refrigerant exiting the condenser 24 flows through the condensate heat exchanger 56 in a counter-flow manner. That is, the refrigerant and the condensate 58 flow in opposite directions.

Figure 6:
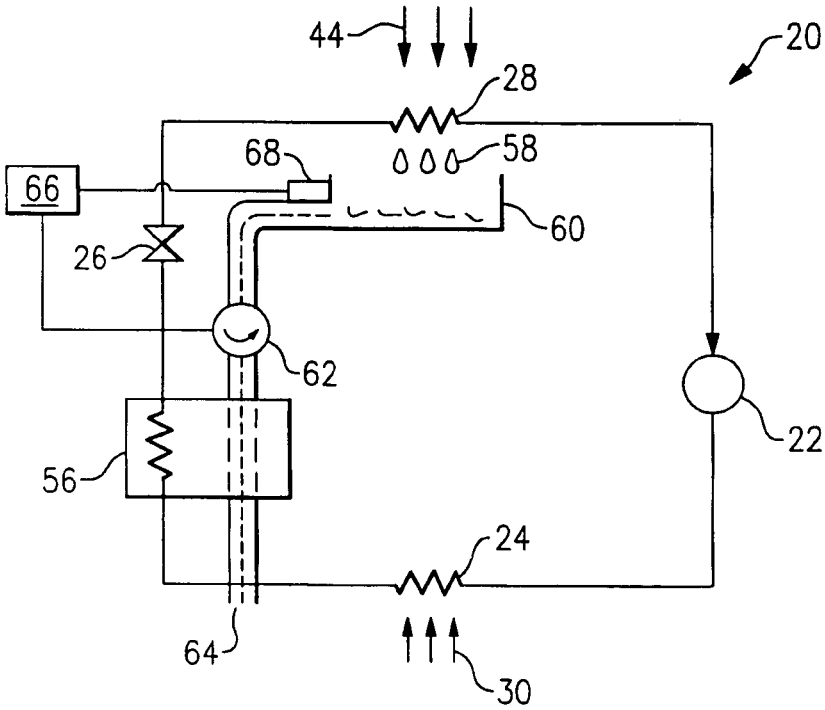
FIG. 6 schematically illustrates a diagram of the fourth embodiment of the vapor compression system of the present invention employing a fluid pumping device.

FIG. 6 schematically illustrates another embodiment. The flow of cold condensate 58 out of the condensate pan 60 and then into the condensate heat exchanger 56 is controlled by a flow control device 62. In the condensate heat exchanger 56, the cold condensate 58 accepts hear from the liquid refrigerant exiting the condenser 24 to further subcool the refrigerant. In one example, the cold condensate 58 is continuously directed into the condensate hear exchanger 56. After accepting heat from the refrigerant in the condensate hear exchanger 56, the heated condensate 58 is drained and removed from the system 20 trough the drain 64.

Alternately, the cold condensate 58 collected in the condensate pan 60 is directed into the condensate heat exchanger 56 when the level sensor 68 detects that the amount of cold condensate 58 collected in the condensate pan 60 is within a selected range. The level sensor 68 then sends a signal to a control 66 to activate a flow control device 62, such as a valve or a pump, to direct the cold condensate 58 collected in the condensate pan 60 into the condensate heat exchanger 56 to accept heat from the refrigerant exiting the condenser 24. Given this description, one skilled in the art would know what the threshold amount of the cold condensate 58 to employ.

When the level sensor 68 detects that the amount of cold condensate 58 collected in the condensate pan 60 is below the threshold amount, the control 66 deactivates the flow control device 62 to stop the flow of the cold condensate 58 into the condensate heat exchanger 56. When the flow control device 62 is deactivated, the liquid refrigerant exiting the condenser 24 and flowing through the condensate heat exchanger 56 is not subcooled because the cold condensate 58 does not flow into and through the condensate heat exchanger 56.

The amount of subcooling obtained by the refrigerant entering the expansion device 26 is no longer limited by the temperature of the external fluid medium 30 (e.g., air). The amount of subcooling is enhanced due to a heat transfer interaction between the refrigerant exiting the condenser 24 and the cold condensate 58 removed from the air stream 44, formed on the surface of the evaporator 28 and collected in the condensate pan 60.

The amount heat transferred in the condensate heat exchanger 56 between the refrigerant exiting the condenser 24 and the cold condensate 58 is determined by the temperature and the amount of the cold condensate 58 collected in the system 20. Therefore, the significantly increased temperature difference between the high pressure liquid refrigerant exiting the condenser 24 and the cold condensate 58 drives the heat transfer process and determines the amount of subcooling of the refrigerant.

It should be understood that the described embodiments can be also used in conjunction or in addition to refrigerant systems where the condensate is applied to the condenser coil as a whole.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

We claim:

1. A vapor compression system comprising:

a condenser;

an evaporator;

an expansion device between the condenser and the evaporator; and a subcooling portion that facilitates subcooling of refrigerant flowing between the condenser and the expansion device using condensate that forms on the evaporator, wherein the subcooling portion is a part of the condenser.

2. The system of claim 1, including a condensate pan associated with the evaporator for at least temporarily collecting the condensate and wherein the subcooling portion further includes a refrigerant line between the condenser and the expansion device and having at least a portion supported for heat exchange between the refrigerant in the refrigerant line and the condensate in the condensate pan.

3. The system of claim 2, wherein the portion of the refrigerant line is positioned to be at least partially immersed in the condensate in the condensate pan.

4. The system of claim 1, further including a heat exchanger that receives at least some of the condensate and further subcools the refrigerant flowing between the condenser and the expansion device.

5. The system of claim 4, including a flow control device that controls a flow of the condensate into the heat exchanger.

6. The system of claim 1, wherein the subcooling portion is a last stage of a condenser coil, and the system further includes a sprayer that sprays at least some of the condensate onto the last stage of the condenser coil.

7. The system of claim 1, wherein the subcooling portion is a last stage of a condenser coil, and the condensate flows onto the last stage of the condenser coil by gravity.

8. The system of claim 1, further including a refrigerant line between the condenser and the expansion device, wherein at least some of the condensate is directed onto the refrigerant line.

9. A vapor compression system comprising:

a condenser;

an evaporator;

an expansion device between the condenser and the evaporator;

a subcooling portion that facilitates subcooling of refrigerant flowing between the condenser and the expansion device using condensate that forms on the evaporator;

a heat exchanger that receives at least some of the condensate and further subcools the refrigerant flowing between the condenser and the expansion device;

a flow control device that controls a flow of the condensate into the heat exchanger;

a condensate pan associated with the evaporator for at least temporarily collecting the condensate;

a control that activates the flow control device; and a level sensor that detects an amount of the condensate collected in the condensate pan, wherein the control activates the flow control device to direct the condensate into the heat exchanger when the level sensor detects that the amount of the condensate collected in the condensate pan exceeds a threshold amount.

10. A method of subcooling refrigerant in a vapor compression system having a condenser, an evaporator and an expansion device between the condenser and the evaporator, the method comprising the step of:

exchanging heat between condensate that forms on the evaporator and the refrigerant that flows between a subcooling portion of the condenser and the expansion device, wherein the subcooling portion is a part of the condenser.

11. The method of claim 10, including directing at least some of the condensate onto a refrigerant line extending from the subcooling portion of the condenser and to the evaporator.

12. The method of claim 11, including spraying the condensate on the refrigerant line.

13. The method of claim 11, including directing at least some of the condensate onto the refrigerant line by gravity.

14. The method of claim 11, including directing at least some of the condensate onto the subcooling portion of the condenser by gravity, wherein the subcooling portion is a last stage of a condenser coil.

15. The method of claim 10 including spraying the condensate on the subcooling portion of the condenser, wherein the subcooling portion is a last stage of a condenser coil.

16. The method as recited in claim 10, including collecting at least some of the condensate in a condensate pan, sensing an amount of the condensate collected in the condensate pan and directing at least some of the condensate onto a refrigerant line extending from the condenser and to the evaporator when the amount of the condensate collected in the condensate pan is above a threshold amount.

17. A vapor compression system comprising:

a condenser;

an evaporator;

an expansion device between the condenser and the evaporator;

a subcooling portion comprising a refrigerant line between the condenser and the expansion device that facilitates subcooling of refrigerant flowing between the condenser and the expansion device using condensate that forms on the evaporator;

a condensate pan including a drain that is associated with the evaporator for at least temporarily collecting the condensate, wherein the refrigerant line has at least a portion supported for heat exchange between the refrigerant in the refrigerant line and the condensate in the condensate pan and the portion is at least partially immersed in the condensate in the condensate pan;

a control;

at least one of a temperature sensor and a level sensor, wherein the control opens the drain to purge the condensate from the condensate pan through the drain when the at least one of a temperature sensor and a level sensor detects a value above a threshold value.

18. The system of claim 17, wherein the at least one of a temperature sensor and a level sensor is a temperature sensor, the value is a temperature of the condensate and the threshold value is a threshold temperature, wherein the control opens the drain to purge the condensate from the condensate pan through the drain when the temperature sensor detects that the temperature of the condensate is above the threshold temperature.

19. The system of claim 17, wherein the at least one of a temperature sensor and a level sensor is a level sensor, the value is an amount of the condensate and the threshold value is a threshold amount of the condensate, wherein the control opens the drain to purge the condensate from the condensate pan through the drain when the level sensor detects that the amount of the condensate is above the threshold amount of the condensate.

20. A vapor compression system comprising:

a condenser;

an evaporator;

an expansion device between the condenser and the evaporator;

a subcooling portion that facilitates subcooling of refrigerant flowing between the condenser and the expansion device using condensate that forms on the evaporator, wherein the subcooling portion comprises a refrigerant line between the condenser and the expansion device; and a condensate pan associated with the evaporator for at least temporarily collecting the condensate, wherein the condensate flows from the condensate pan and onto the refrigerant line by gravity.

21. The system of claim 20, wherein the subcooling portion includes a heat exchanger that receives at least some of the condensate from the condensate pan and further subcools the refrigerant flowing between the condenser and the expansion device.

22. The system of claim 21 wherein the subcooling portion includes a sprayer that sprays at least some of the condensate onto the refrigerant line.

23. The system of claim 22, including a flow control device that controls a flow of the condensate to the sprayer.

24. A method of subcooling refrigerant in a vapor compression system having a condenser, an evaporator and an expansion device between the condenser and the evaporator, the method comprising the steps of:

exchanging heat between condensate that forms on the evaporator and the refrigerant that flows between a subcooling portion and the expansion device;

collecting at least some of the condensate in a condensate pan and directing the refrigerant through a conduit that is positioned to be at least partially immersed in the condensate collected in the condensate pan;

controlling a drain in the condensate pan; and purging the condensate from the condensate pan through the drain when at least one of a temperature sensor and a level sensor detects a value above a threshold value.

25. The method of claim 24, wherein the at least one of a temperature sensor and a level sensor is a temperature sensor, the value is a temperature of the condensate, and the threshold value is a threshold temperature, the method including the step of sensing the temperature of the condensate collected in the condensate pan, wherein the step of purging the condensate from the condensate pan includes purging the condensate when the temperature is above the threshold temperature.

26. The method of claim 24, wherein the at least one of a temperature sensor and a level sensor is a level sensor, the value is an amount of the condensate, and the threshold value is a threshold amount of the condensate, the method including the step of sensing an amount of the condensate collected in the condensate pan, wherein the step of purging the condensate from the condensate pan includes purging the condensate when the amount of the condensate is above a threshold amount of the condensate.

* * * * *